US007712585B2

(12) United States Patent
Hoth

(10) Patent No.: US 7,712,585 B2
(45) Date of Patent: May 11, 2010

(54) LIFTING DEVICE

(75) Inventor: Tobias Hoth, Pegnitz (DE)

(73) Assignee: Siemens Aktiengesellschaft, Munich (DE)

( * ) Notice: Subject to any disclaimer, the term of this patent is extended or adjusted under 35 U.S.C. 154(b) by 125 days.

(21) Appl. No.: 12/024,413

(22) Filed: Feb. 1, 2008

(65) Prior Publication Data

US 2008/0190707 A1 Aug. 14, 2008

(30) Foreign Application Priority Data

Feb. 13, 2007 (DE) ..... 102007007101

(51) Int. Cl.
*B66B 9/02* (2006.01)
*B66F 3/22* (2006.01)
*A47B 9/00* (2006.01)

(52) U.S. Cl. ..... 187/269; 254/122; 108/144.11

(58) Field of Classification Search ..... 187/211, 187/269; 254/122; 108/144.1
See application file for complete search history.

(56) References Cited

U.S. PATENT DOCUMENTS 2,471,901 A * 5/1949 Ross ..... 254/9 C
3,110,476 A * 11/1963 Farris ..... 254/122
5,598,591 A * 2/1997 Kelley ..... 5/118
7,111,825 B2 * 9/2006 Landsberger et al. ..... 254/126
7,331,425 B2 * 2/2008 Bukowski et al. ..... 187/269
2008/0105497 A1 * 5/2008 Ashley et al. ..... 187/269

FOREIGN PATENT DOCUMENTS

| | | | |
|---|---|---|---|
| DE | 26 22 408 A1 | | 12/1976 |
| DE | 18 05 941 C3 | | 5/1980 |
| DE | 87 14 697 U1 | | 3/1989 |
| FR | 1 256 920 A | | 3/1961 |
| GB | 2267695 A | * | 12/1993 |
| JP | 07267595 A | | 10/1995 |

OTHER PUBLICATIONS

German Office Action dated Feb. 11, 2008 for DE 10 2007 007 101.0-26 with English translation.

* cited by examiner

*Primary Examiner*—Thomas J. Brahan
*Assistant Examiner*—Stefan Kruer
(74) *Attorney, Agent, or Firm*—Brinks, Hofer, Gilson & Lione

(57) ABSTRACT

A lifting device adjusts the height of a top part relative to a base part for a patient couch. The lifting device includes an elevator mechanism and a drive unit for height adjustment. The elevator mechanism has a scissor mechanism with two scissor arms, which are pivotably connected together via a scissor pivot joint. The elevator mechanism further includes an elbow mechanism having two elbow arms, which are pivotably connected together via an elbow pivot joint. Each of the elbow arms is linked to a scissor arm via a linking pivot joint.

14 Claims, 1 Drawing Sheet

LIFTING DEVICE

The present patent document claims the benefit of German patent application DE 10 2007 007 101.0, filed Feb. 13, 2007, which is hereby incorporated by reference.

BACKGROUND

The present embodiments relate to a lifting device for adjusting the height of a top part relative to a base part for a patient couch (e.g., support, table, or stretcher).

Lifting devices of this kind are known from the prior art and are used for the vertical positioning of a patient couch or a patient table. The top part and the base part are usually embodied in the form of panels or frames which can be moved relative to each other by an elevator mechanism, thereby resulting in a height adjustment of the top part relative to the base part.

A suitable elevator mechanism for a lifting device is, for example, a simple scissor mechanism. A simple scissor mechanism is a paired embodiment of two levers which cross each other at a scissor pivot joint. The two "scissors" are configured in parallel with each other and move synchronously. Each of these "scissors" is mounted on the top part and the base part at two support points in each case. A simple scissor mechanism is characterized by a high degree of stiffness due to the large distances between the support points on the top part and base part. In the case of a limited length of the top part or of the base part, however, a simple scissor construction cannot be moved very far down due to the lever ratios.

Alternatively, a dual or multiple scissor mechanism may be provided. In the case of a dual or multiple scissor mechanism, two or more "scissors" are configured one above the other. The lowermost of the scissors is mounted on the base part and the uppermost on the top part at two support points in each case. Such a scissor mechanism is likewise embodied in a paired manner. Provision is made for two parallel constructions of "scissors" which are configured one above the other, such that four support points are actually formed on the top part and on the base part respectively.

When comparing a dual-scissor mechanical arrangement with a simple scissor mechanism, given the same length of the top part and of the base part, the dual-scissor mechanical arrangement may be contracted further downward. As a result of the short distances between the support points, however, the dual-scissor arrangement has a lower degree of stiffness than a simple scissor mechanism.

SUMMARY AND DESCRIPTION

The present embodiments may provide an improved scissor mechanism.

A lifting device adjusts the height of a top part relative to a base part for a patient couch by an elevator mechanism and a drive unit for height adjustment. The elevator mechanism has a scissor mechanism with two scissor arms which are pivotably connected together via a scissor pivot joint. The elevator mechanism includes an elbow mechanism having two elbow arms which are pivotably connected together via an elbow pivot joint. Each of the elbow arms is linked to a scissor arm via a linking pivot joint.

As a result of the simple scissor mechanism, the lifting device may be characterized by a high degree of stiffness. By virtue of the elbow mechanism, improved lever ratios for adjusting the elevator mechanism may be also present. Adjustment of the top part relative to the base part may be easier to perform. The elevator mechanism may possess higher efficiency than a simple scissor mechanism.

The scissor pivot joint and the linking pivot joint are always situated at the same height in one embodiment. Both elbow arms have the same length. This type of configuration results in a symmetrical distribution of the forces introduced into the elevator mechanism by the drive unit. The distribution may be advantageous for precise adjustment of the top part relative to the base part.

In one embodiment, the elbow arms are configured in parallel with the scissor arms. This can be achieved by selecting a suitable length for the elbow arms.

This further assists the distribution of forces in the elevator mechanism.

One elbow arm is, according to another embodiment, extended and connected to the top part or the base part. The mounting of the extended elbow arm on the top part or on the base part creates a further, third support point for the scissor mechanism on one of the parts, thereby reducing the distortion of the top or base part. This may result in a higher degree of stiffness of the overall lifting device.

In order to increase the stiffness of the lifting device further, one embodiment provides both elbow arms extended and connected to the top part or the base part, such that a third support point is formed on both the top part and the base part.

In order to allow a particularly easy expansion and contraction of the dual-scissor construction, at least two of the three mounting connections, by which the elevator mechanism is connected to the top part and the base part at the support points in the case of extended elbow arms, are implemented to be movable. For example, precisely two of the mounting connections are embodied to be movable and the third to be fixed.

Rail guides may be provided for the movable mounting connections. Rail guides represent a particularly simple and efficient possibility for carrying out a linear movement in a predetermined direction and the corresponding return movement.

The drive unit may act on the elbow pivot joint and is embodied to effect a linear movement of the elbow pivot joint in a vertical direction. This may be achieved by virtue of the drive unit acting directly below the elbow pivot joint. As a result of this, in particular a constant speed of travel is achieved. The proposed construction is also characterized by virtually constant active forces and a particularly precise synchronism. Where only a single drive unit is used in one embodiment, no separate synchronization control is required.

According to a further embodiment, the drive unit has a spindle and a motor. In contrast with known solutions which primarily work using high-maintenance hydraulic cylinders, a spindle and motor type of drive unit requires comparatively little maintenance. In this context, a vertically oriented spindle may be driven via a corresponding transmission by an electric motor whose axis of rotation runs perpendicular to the axis of the spindle. As a result of this, a particularly space-saving implementation of the lifting device may be possible.

The motor is suitably attached to the base part. This has the advantage that sufficient space for the motor control is available above the motor. Moreover, no movable cable ducting is required.

According to one variant, the scissor arms and/or the elbow arms are cast parts. The manufacture of the scissor arms and/or elbow arms may be simple and may require little time.

According to a further variant, the scissor arms and/or the elbow arms have ribs. This solution may be economical in terms of material and weight, and may be at the same time characterized by a high degree of stiffness. The scissor arms or elbow arms, which may be developed as cast parts here, are formed in this case by a peripheral frame structure with the ribs designed as stiffening braces.

BRIEF DESCRIPTION OF THE DRAWINGS

Exemplary embodiments are explained in further detail with reference to a drawing, in which.

Parts which correspond to each other and have identical effect are given the same reference signs in all figures.

DETAILED DESCRIPTION

Figure 1:
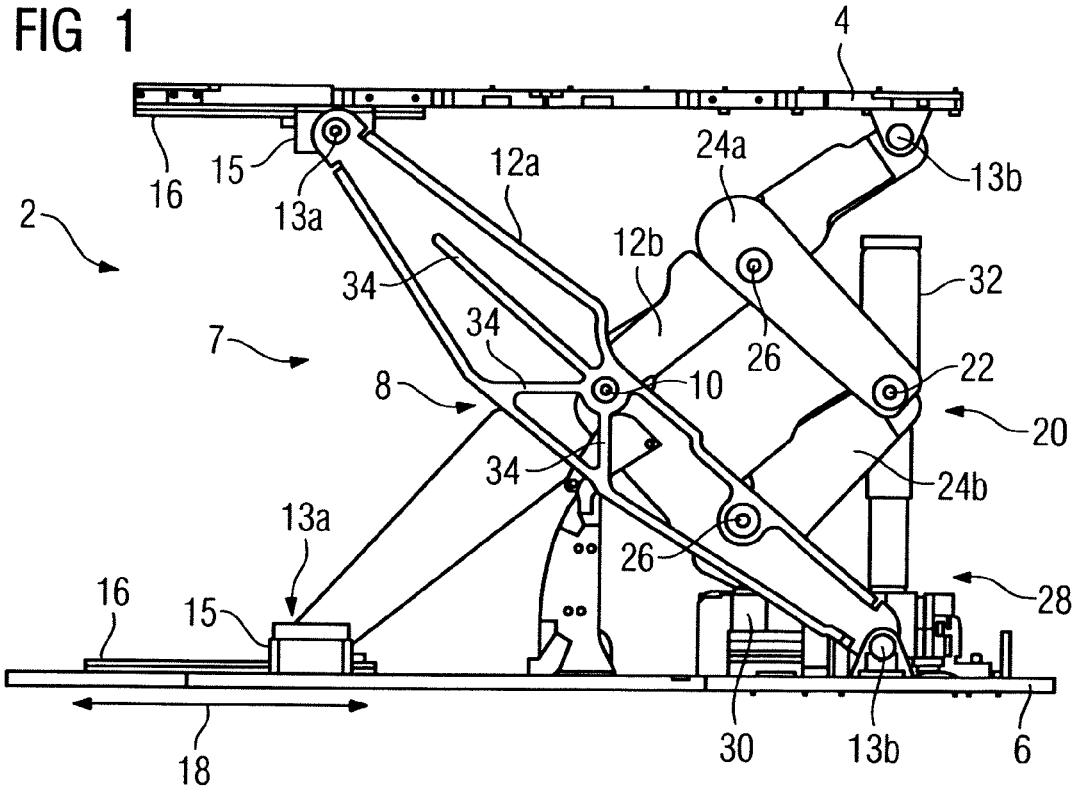
FIG. 1 shows one embodiment of a side view of a lifting device in the expanded position including an elbow mechanism.

FIG. 1 shows a lifting device 2 for adjusting the height of a top part 4 relative to a base part 6. The top part 4 and the base part 6 are both in the form of a panel in this exemplary embodiment. In particular, the lifting device 2 is provided for adjusting the height of a patient couch (not shown) which is mounted on the top part 4. The movement of the top part 4 is performed via an elevator mechanism 7. The elevator mechanism 7 includes a scissor mechanism 8, which has two scissor arms 12*a*, 12*b* that cross each other at a scissor pivot joint 10. Each of the scissor arms 12*a*, 12*b* is mounted on the top panel 4 and base panel 6 via a movable mounting connection 13*a* and a fixed mounting connection 13*b*.

For the movable mounting, the scissor arms 12*a*, 12*b* are linked to slides 15. When the scissor mechanism 8 is opened and closed, the slides 15 slide back and forth in direction of travel 18 on a rail 16 which is attached to the corresponding panel 4, 6, thereby guiding the scissor arms 12*a* and 12*b* in direction of travel 18. At the same time, the scissor arms 12*a* and 12*b* are mounted in a stationary manner on the base part 6 or top part 4 via the pivot joint connections 13*b*.

The elevator mechanism 7 additionally includes an elbow mechanism 20. The elbow mechanism 20 is formed from two elbow arms 24*a*, 24*b*. The elbow arms 24*a*, 24*b* connect via an elbow pivot joint 22. The elbow arms 24*a*, 24*b* are coupled to the scissor arms 12*a*, 12*b* via a linking pivot joint 26 in each case. The linking pivot joints 26 are positioned midway between the scissor pivot joint 10 and the corresponding mounting connection 13*b* in this exemplary embodiment. In this case the distance between the elbow pivot joint 22 and the linking pivot joint 26 corresponds to the distance between the scissor pivot joint 10 and the linking pivot joint 26, such that the scissor pivot joint 10 and the elbow pivot joint 22 are always at the same height and the elbow arms 24*a*, 24*b* run parallel to the scissor arms 12*a*, 12*b*.

The lifting device 2 additionally includes a drive unit 28. The drive unit 28 has an electric motor 30 attached horizontally on the base part 6 and a vertical spindle 32, such as a telescopic spindle. In this context, the rotational movement of the electric motor 30 is translated via a transmission (not shown in greater detail) into a linear movement of the spindle 32. The spindle 32 is in turn pivotably connected at the spindle head to the elbow pivot joint 22 of the elbow mechanism 20. In order to effect a height adjustment of the top panel 4, the electric motor 22 is switched on and the telescopic spindle 24 is extended or retracted. In this case the elbow pivot joint 22 performs a linear movement in a vertical direction, at a constant speed of travel. The linear movement is transferred to the scissor pivot joint 10, and the slides 15 of the scissor arms 12*a*, 12*b* move in the direction of travel 18. In this case, the axis of rotation of the electric motor 30 runs perpendicular to the axis of the spindle. For safety reasons, the transmission of the electric motor 30 is an irreversible transmission, and therefore the telescopic spindle 32 does not have any return play. In the case of the proposed arrangement, sufficient space is provided above the electric motor 30 for the arrangement of a motor control (not shown).

Figure 2:
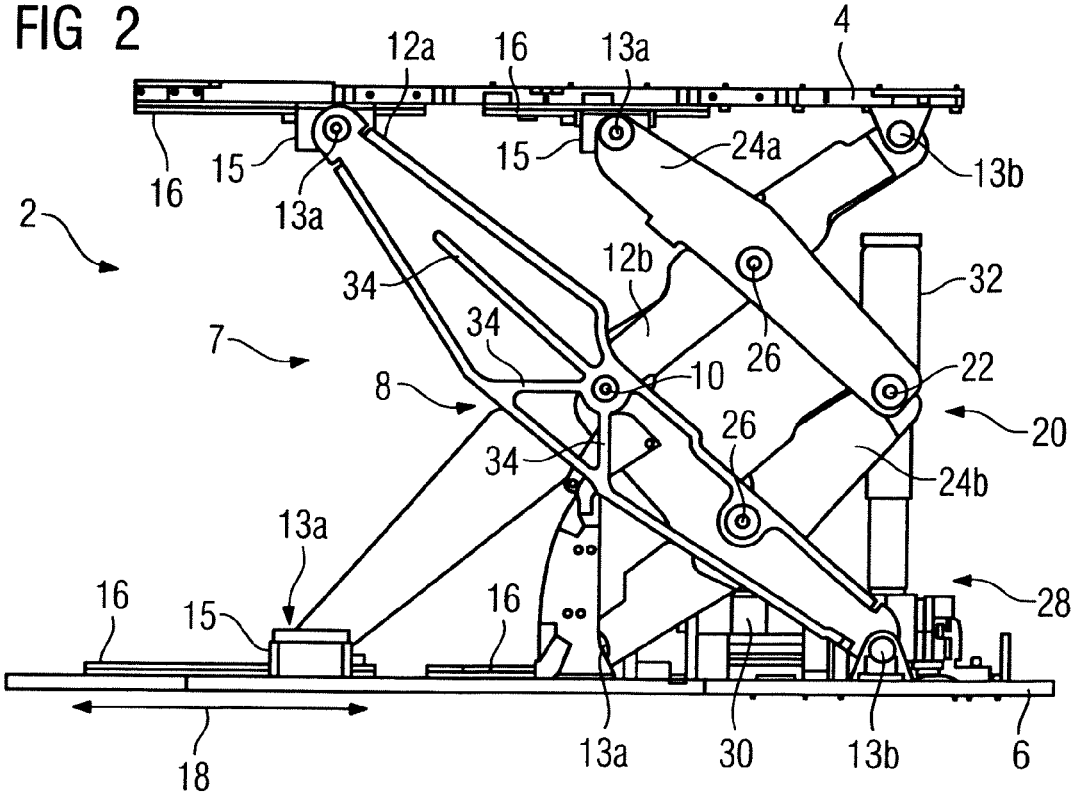
FIG. 2 shows a side view of the lifting device according to FIG. 1 with extended elbow arms of the elbow mechanism.

The scissor arms 12*a*, 12*b* in this exemplary embodiment are cast parts, which have a frame structure and a number of ribs 34 for increasing the stiffness. This is shown in FIG. 2 with reference to the scissor arm 12*a*. The elbow arms 24*a*, 24*b* are likewise cast parts and may be equipped with ribs.

A further lifting device 2 having increased stiffness is illustrated in FIG. 2. With regard to the construction of the elbow mechanism 20, both elbow arms 24*a*, 24*b* have an extended form in this exemplary embodiment. It is also possible for only one elbow arm 24*a*, 24*b* to be embodied in an extended form and be mounted on the base or top part 6, 4, whereby the stiffness of the construction is likewise increased. The elbow arms 24*a*, 24*b* in FIG. 2 are in each case mounted on the top part 4 or base part 4 in a movable manner via a slide 15, which slides in a further rail guide 16. The elevator mechanism 7 is therefore mounted on both the base part 6 and the top part 4 via three mounting connections 13*a*, 13*b*, two of these three mounting connections being movable in each case and the third being a stationary pivot joint connection 13*b*.

In this exemplary embodiment, the elevator mechanism 7 is implemented in particular in the form of a scissor set, such that further twin arms are situated behind the scissor arms 12*a*, 12*b* and the elbow arms 24*a*, 24*b* in the plane of the drawing. The twin arms have the same structure as the scissor and elbow arms 12*a*, 12*b*, 24*a*, 24*b* and are therefore not visible due to the angle of view that is illustrated. The arms 12*a*, 12*b*, 24*a*, 24*b* are connected to their twin arms in particular via the scissor pivot joint 10 and the elbow pivot joint 22. In the exemplary embodiment shown here, the arms 12*a*, 12*b*, 24*a*, 24*b* and the twin arms are connected together by transverse bars or shafts which run perpendicular to the plane of the drawing, such that the forces which occur as a result of the vertical movement of the spindle 32 have an approximately equal effect on the parallel scissor construction.

While the invention has been described above by reference to various embodiments, it should be understood that many changes and modifications can be made without departing from the scope of the invention. It is therefore intended that the foregoing detailed description be regarded as illustrative rather than limiting, and that it be understood that it is the following claims, including all equivalents, that are intended to define the spirit and scope of this invention.

The invention claimed is:

1. A lifting device for adjusting the height of a top part relative to a base part for a patient couch, the lifting device comprising:

an elevator mechanism and a drive unit for height adjustment, wherein the elevator mechanism has a scissor mechanism with two scissor arms, the scissor arms being pivotably connected together via a scissor pivot joint, wherein the elevator mechanism comprises an elbow mechanism having two elbow arms pivotably connected together via an elbow pivot joint, each of the elbow arms being linked to one of the scissor arms via a linking pivot joint, and wherein the drive unit is directly connected to the elbow pivot joint and moves the elbow pivot joint linearly in a vertical direction relative to the base part.

2. The lifting device as claimed in claim 1, wherein the scissor pivot joint and the linking pivot joint are always at the same height.

3. The lifting device as claimed in claim 1, wherein the elbow arms are arranged in parallel with the scissor arms.

4. The lifting device as claimed in claim 1, wherein one elbow arm is extended and is connected to the top part or the base part.

5. The lifting device as claimed in claim 1, wherein both elbow arms are extended and are connected to the top part and the base part respectively.

6. The lifting device as claimed in claim 1, wherein the elevator mechanism is mounted on the top part and base part via three mounting connections, of which at least two are movable mounting connections.

7. The lifting device as claimed in claim 1, wherein the drive unit has a spindle and a motor.

8. The lifting device as claimed in claim 1, wherein the scissor arms and the elbow arms are cast parts.

9. The lifting device as claimed in claim 2, wherein the elbow arms are arranged in parallel with the scissor arms.

10. The lifting device as claimed in claim 6, wherein rail guides are provided for the movable mounting connections.

11. The lifting device as claimed in claim 1, wherein the drive unit has a spindle and a motor.

12. The lifting device as claimed in claim 7, wherein the motor is attached to the base part.

13. The lifting device as claimed in claim 9, wherein both elbow arms are extended and are connected to the top part and the base part respectively.

14. The lifting device as claimed in claim 13, wherein the elevator mechanism is mounted on the top part and base part via three mounting connections, of which at least two are movable mounting connections.

* * * * *